US008064801B2

(12) United States Patent
Sugiyama et al.

(10) Patent No.: US 8,064,801 B2
(45) Date of Patent: Nov. 22, 2011

(54) DRIVE TRANSMISSION DEVICE, AND IMAGE FORMING APPARATUS AND PROCESS CARTRIDGE USING SAME

(75) Inventors: Keisuke Sugiyama, Yokohama (JP); Yasuhisa Ehara, Kamakura (JP); Toshiyuki Uchida, Kawasaki (JP); Noriaki Funamoto, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 376 days.

(21) Appl. No.: 12/232,296

(22) Filed: Sep. 15, 2008

(65) Prior Publication Data

US 2009/0074506 A1 Mar. 19, 2009

(30) Foreign Application Priority Data

Sep. 14, 2007 (JP) ..... 2007-238744

(51) Int. Cl.
*G03G 15/00* (2006.01)

(52) U.S. Cl. ..... 399/167

(58) Field of Classification Search ..... 74/405, 74/406, 665 R, 665 G–665 GE; 399/167; 492/15

See application file for complete search history.

(56) References Cited

U.S. PATENT DOCUMENTS

| | | | | |
|---|---|---|---|---|
| 2,314,833 | A * | 3/1943 | Keese | 74/665 GA |
| 7,599,645 | B2 | 10/2009 | Hara et al. | |
| 2002/0085858 | A1 * | 7/2002 | Yamaguchi et al. | 399/167 |
| 2007/0003321 | A1 | 1/2007 | Hara et al. | |

FOREIGN PATENT DOCUMENTS

| | | |
|---|---|---|
| CN | 1892476 | 1/2007 |
| JP | 2000-075765 | 3/2000 |
| JP | 2000-276030 | 10/2000 |
| JP | 2006-047701 | 2/2006 |

* cited by examiner

*Primary Examiner* — Gregory Binda

(74) *Attorney, Agent, or Firm* — Harness, Dickey & Pierce, P.L.C.

(57) ABSTRACT

A drive transmission device that performs drive transmission through a plurality of systems and includes a first involute spline joint to perform drive transmission to a primary rotating body to be driven and a second involute spline joint to perform drive transmission to a secondary rotating body to be driven.

6 Claims, 9 Drawing Sheets

DRIVE TRANSMISSION DEVICE, AND IMAGE FORMING APPARATUS AND PROCESS CARTRIDGE USING SAME

BACKGROUND OF THE INVENTION

1. Field of the Invention

The present invention relates to a drive transmission device for transmitting rotation to a rotating body with high accuracy, and an image forming apparatus and a process cartridge using the drive transmission device.

2. Description of the Related Art

In recent years, the image quality and image forming speed of image forming apparatuses, such as copying machines, printers, and facsimile machines, have improved markedly. For this reason, when rotational fluctuations occur in a photosensitive member and a rotating body included in an image forming unit such as a developing unit or a transfer unit, the image density of the resulting image tends to become uneven. Avoiding such density unevenness requires high rotation accuracies of the rotating bodies.

In particular, the rotational load of the developing unit is heavy, and therefore, it is effective to separate a drive transmission system of the developing unit from a drive transmission system of the photosensitive member, since rotational fluctuations of the photosensitive member greatly affect the image quality. On the other hand, in order to improve the image quality, it is important to accurately ensure a gap (developing gap) between the photosensitive member and a developing roller in the developing unit. Moreover, for extended working life and easy replacement, it is preferable that the image forming unit be removable from the apparatus body.

As a method and configuration that meet such demands for rotational accuracies of a plurality of rotating bodies and positional accuracy between the rotating bodies, it has been proposed to use a coupling to transmit the rotation from a driving system of the main body of an image forming apparatus to rotating bodies in an image forming unit.

An involute spline joint is known as a rotation transmission means for achieving high-accuracy rotation. FIG. 1 is a perspective view schematically showing the structure of a rotation transmission device using an involute spline joint. A photosensitive member 101 serving as an image bearing member is rotatably supported by a photosensitive member shaft 102. One end of the photosensitive member shaft 102 serves as a photosensitive-member-side joint 103 to which rotation is transmitted. In the rotation transmission device having this structure, the input from a photosensitive-member driving motor 106, such as a DC servo motor or a stepping motor, is transmitted to a driving-side joint 104 via a photosensitive-member driving shaft 105, and the photosensitive member 101 is rotated by engagement of the driving-side joint 104 with the photosensitive-member-side joint 103.

Further, coupling structures for independently transmitting the drive force to a photosensitive member and a developing unit or the like are disclosed. In one coupling structure, the drive force is transmitted to a photosensitive member by a joint shaped like a twisted triangular prism and to another image forming unit by a two-claw joint. In another coupling structure, the drive force is transmitted to the photosensitive member by an involute spline joint, and to another image forming unit by an Oldham coupling.

In the device shown in FIG. 1, high-accuracy rotation is achieved by using the involute spline joint to rotate the photosensitive member or another image forming unit. However, there is no attention paid to the positional accuracy between the rotating bodies. Further, in the above-described coupling structures, the rotation transmission systems are separately provided for the photosensitive member and another image forming unit, and the photosensitive member is accurately rotated using the involute spline joint or the joint shaped like a triangular prism. In contrast, the two-claw joint or the Oldham coupling is used for another image forming unit, and this may cause rotational fluctuations.

SUMMARY OF THE INVENTION

Because of these reasons, the present inventors recognize that a need exists for a drive transmission device that simultaneously secures the rotational accuracy of a photosensitive drum or photoreceptor and a rotational body in an image forming elements such as a developing device (developing roller) and the positional accuracy between the photosensitive drum and such a rotational body to avoid image density unevenness.

Accordingly, an object of the present invention is to provide a drive transmission device that simultaneously secures the rotational accuracy of a photosensitive drum or photoreceptor (i.e., primary rotating body) and a rotational body in an image forming elements such as a developing device (developing roller) and a transfer unit and the positional accuracy between the photosensitive drum and such a rotational body to avoid image density unevenness.

Briefly this object and other objects of the present invention as hereinafter described will become more readily apparent and can be attained, either individually or in combination thereof, by a drive transmission device that performs drive transmission through a plurality of systems, the device including a first involute spline joint to perform drive transmission to a primary rotating body to be driven and a second involute spline joint to perform drive transmission to secondary rotating body to be driven.

It is preferred that, in the drive transmission device, the first involute spline joint corresponding to the primary rotating body is coupled earlier than the second involute spline joint corresponding to the secondary rotating body.

It is still further preferred that, in the drive transmission device, the second involute spline joint for the secondary rotating body is subjected to profile shifting.

It is still further preferred that, in the drive transmission device, each of the first and second involute spline joints is combined with a speed reduction mechanism.

It is still further preferred that, in the drive transmission device, a dimensional tolerance of a joint-side bearing of each of the first and second involute spline joints is set to accept axis misalignment and a dimensional tolerance of an opposite-side bearing is set to be a dimensional tolerance for determining a position of an axis of each of the first and second involute spline joints.

It is still further preferred that, in the drive transmission device, the primary rotating body is a photosensitive member, and the secondary rotating body is a developing roller.

As another aspect of the present invention, an image forming apparatus is provided which includes a primary rotating body, a secondary rotating body and the drive transmission device mentioned above.

As another aspect of the present invention, a process cartridge is provided which includes a primary rotating body to be driven by the drive transmission device mentioned above; and a secondary rotating body to be driven by the drive transmission device mentioned above and the process cartridge is removably mounted in an image forming apparatus.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

A best mode for carrying out the present invention will be described below with reference to an illustrated embodiment.

Figure 2:
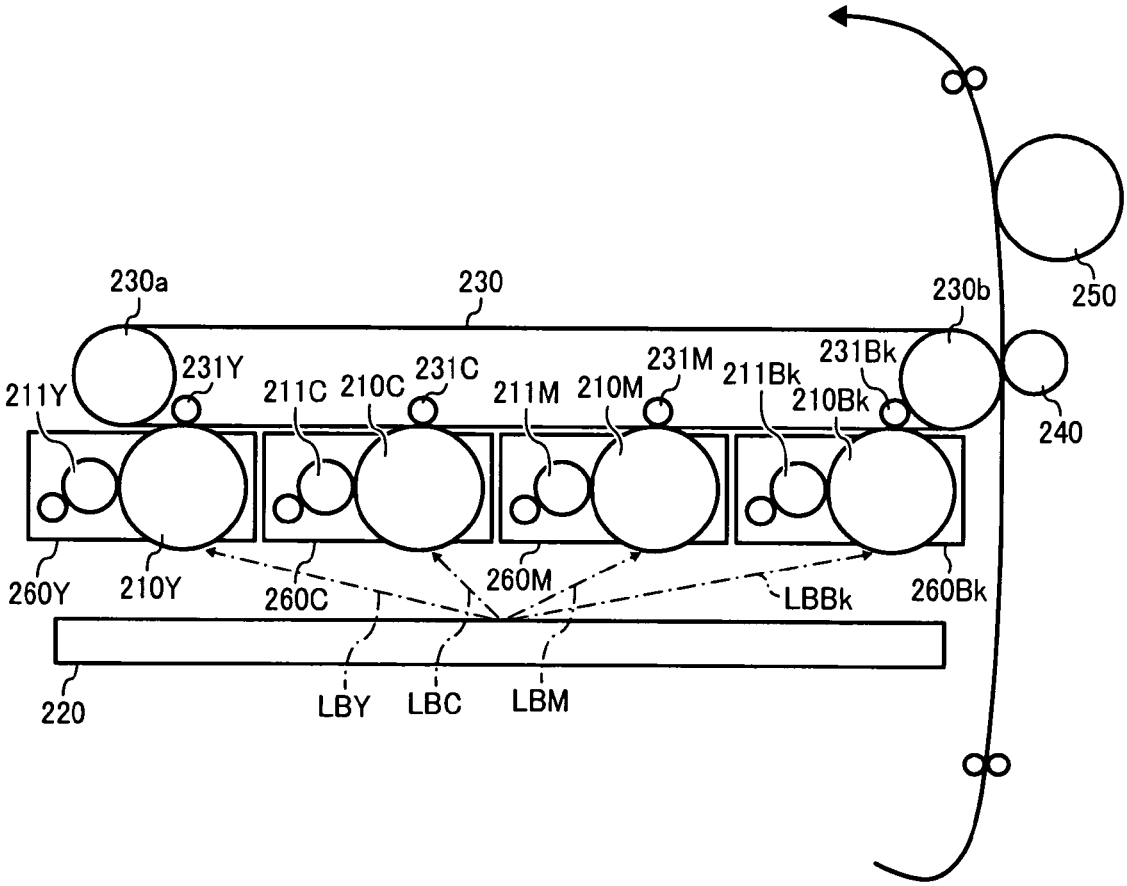
FIG. 2 shows a main configuration of an image forming unit in an image forming apparatus according to an embodiment of the present invention.

FIG. 2 shows a main configuration of an image forming unit in an image forming apparatus according to an embodiment of the present invention. This image forming apparatus is formed by a tandem color image forming apparatus using electrophotography. In the image forming apparatus, primary rotating bodies (i.e., photosensitive drums 210Y, 210C, 210M, and 210Bk in this case) are respectively provided for four colors of yellow (Y), cyan (C), magenta (M), and black (Bk). Image forming elements, such as charging units, secondary rotating bodies (i.e., developing rollers 211Y, 211C, 211M, and 211Bk in this case), primary transfer rollers 231Y, 231C, 231M, and 231Bk, cleaning units, and discharging units, are respectively provided along the outer peripheries of the photosensitive drums 210Y, 210C, 210M, and 210Bk. An optical writing unit is provided downstream from each charging unit in the rotating direction of the photosensitive drum, and performs optical writing with laser light emitted for optical writing from a laser exposure unit 220. For example, the laser exposure unit 220 shapes the waveform of laser light emitted from laser diodes (LD) provided corresponding to the colors, and applies laser light beams LBY, LBC, LBM, and LBBk, which have been modulated according to image information, in the axial direction of the photosensitive drums 210Y, 210C, 210M, and 210Bk (main scanning direction) by a polygonal mirror. In the embodiment shown in FIG. 2, process cartridges 260Y, 260C, 260M, and 260Bk corresponding to the colors are provided removably. Each of the process cartridges 260Y, 260C, 260M, and 260Bk includes the corresponding photosensitive drum 210Y, 210C, 210M, or 210Bk, at least one of the image forming elements arranged on the outer periphery of the photoconductive drum, namely, the charging unit (not shown), the developing roller 211Y, 211C, 211M, or 211Bk, the cleaning unit, and the discharging unit, and driving mechanisms for the photosensitive drum and the image forming element.

An intermediate transfer belt 230 is tensely stretched between a driving roller 230*a* and a driven roller 230*b* in a manner such as to be in contact with the photosensitive drums 210Y, 210C, 210M, and 210Bk. Onto the intermediate transfer belt 230, toner images on the photosensitive drums 210Y, 210C, 210M, and 210Bk are transferred by the primary transfer rollers 231Y, 231C, 231M, and 231Bk, respectively. A secondary transfer roller 240 is provided at a position where the intermediate transfer belt 230 faces the driven roller 230*b*. Transfer paper is conveyed through a nip between the intermediate transfer belt 230 and the secondary transfer roller 240, and toner images on the intermediate transfer belt 230 are transferred thereon by the secondary transfer roller 240. Further, a fixing roller 250 for fixing the toner image onto the transfer paper is provided downstream from the nip between the intermediate transfer belt 230 and the secondary transfer roller 240 in the conveying direction of the transfer paper.

In the image forming apparatus including the image forming unit having the above-described configuration, first, laser light is applied from the laser exposure unit 220 onto the surfaces of the photosensitive drums 210Y, 210C, 210M, and 210Bk so as to form electrostatic latent images thereon. Then, toner is conveyed to the photosensitive drums 210Y, 210C, 210M, and 210Bk by the developing rollers 211Y, 211C, 211M, and 211Bk adjacent to the corresponding photosensitive drums so as to form visible toner images. The visible toner images of the colors Y, C, M, and Bk formed on the photosensitive drums 210Y, 210C, 210M, and 210Bk are transferred in that order onto the intermediate transfer belt 230 that is in contact with the photosensitive drums 210Y, 210C, 210M, and 210Bk. Further, the toner images are transferred onto transfer paper, which is conveyed at an appropriate timing, by the secondary transfer roller 240, and are fused and pressed by the fixing roller 250, so that an image is formed on the transfer paper. While a full color image can be obtained by forming images of four colors, an image can be formed with only one color or two colors.

In the following description, when the photosensitive drums are generically described, the indices Y, C, M, and Bk indicating the colors are omitted.

Figure 3:
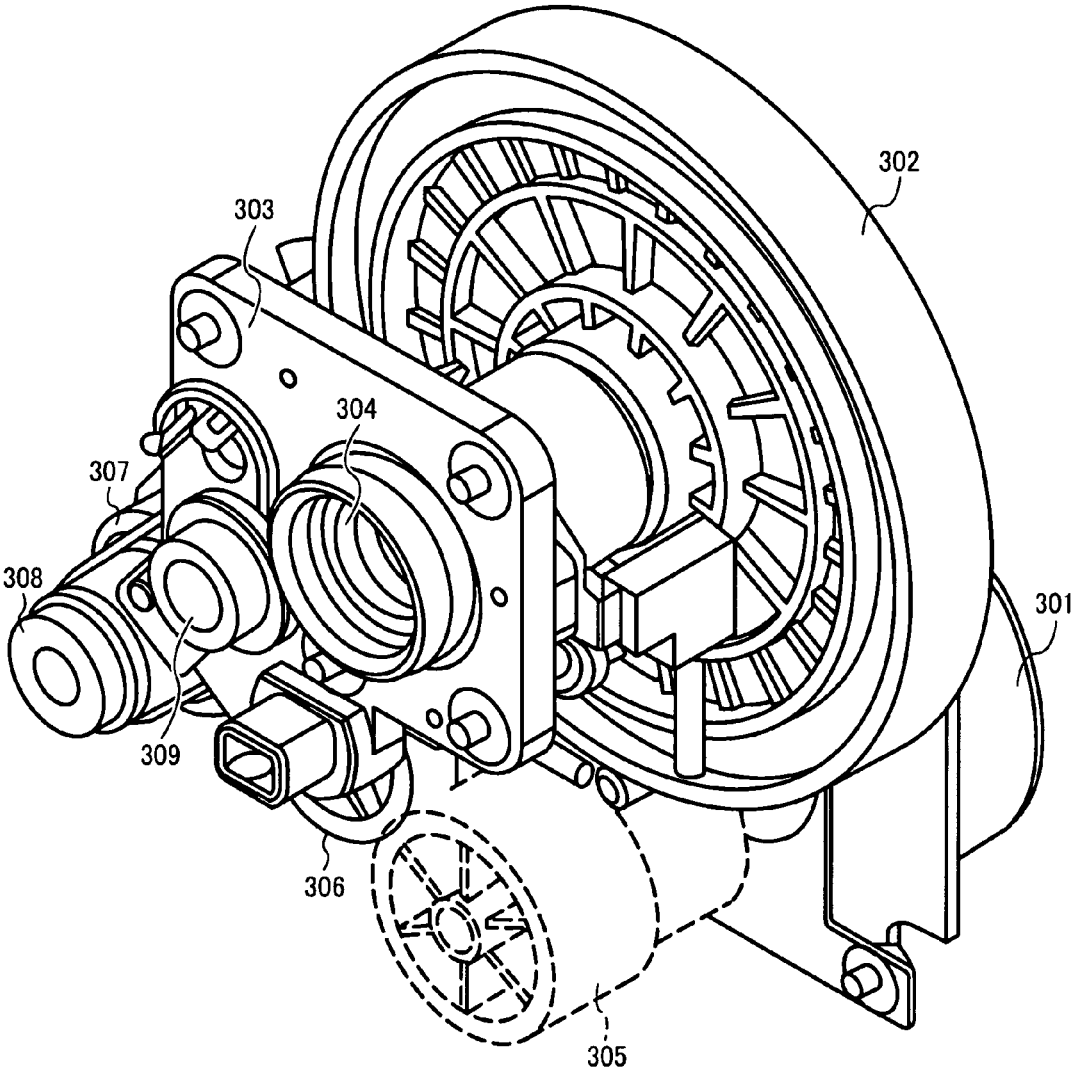
FIG. 3 is a perspective view showing an example of a drive transmission device according to the embodiment.

FIG. 3 is a perspective view showing an example of a drive transmission device according to the embodiment. For example, a first rotating-body driving system is constituted by a driving motor 301, such as a DC servo motor or a stepping motor, a gear 302 for reducing the driving speed of the driving motor 301, an involute spline joint 304, and a shaft support member 303 fixed to the apparatus body. The involute spline joint 304 is supported at both ends by a coupling-side bearing member and a corresponding bearing (not shown). A second rotating-body driving system is constituted by a train of reduction gears 305, 306, 307, and 308 and an involute spline joint 309. The involute spline joint 309 is rotatably supported by the shaft support member 303, similarly to the involute spline joint 304. Similarly, the involute spline joint 309 is supported at both ends by a coupling-side bearing member and a corresponding bearing (not shown). In the first rotating-body driving system shown in FIG. 3, the rotation input from the driving motor 301 is transmitted to the gear 302 for obtaining a desired reduction ratio, and the involute spline joint 304 provided coaxially with the gear 302 is thereby driven. The involute spline joint 304 in the driving device is meshed with and fitted on an involute spline joint on a driven side (not shown) so as to transmit the rotation. Since the involute spline joint 304 is driven only via one gear having a large diameter and provided between the driving motor 301 and the involute spline joint 304, the component configuration can be simplified, and transmission loss can be minimized. On the other hand, in view of actual specifications of the motor used in the image forming apparatus or from the viewpoint of flexibility in component layout, it is also useful to form a reduction gear train using a motor and a toothed belt pulley, as in the second rotating-body driving system shown in FIG. 3.

Figure 4A:
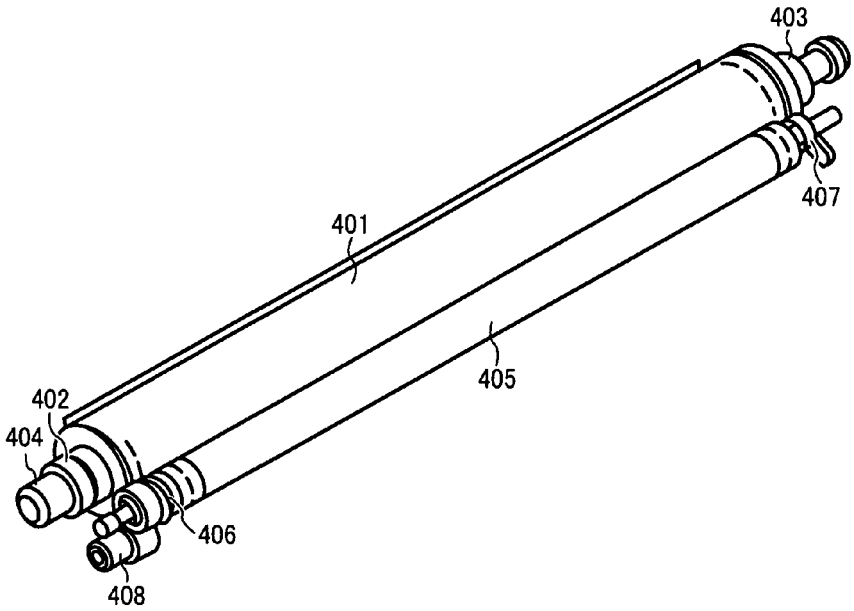
FIGS. 4A and 4B show an example in which a photosensitive member and a developing roller serve as driven-side rotating bodies.
Figure 4B:
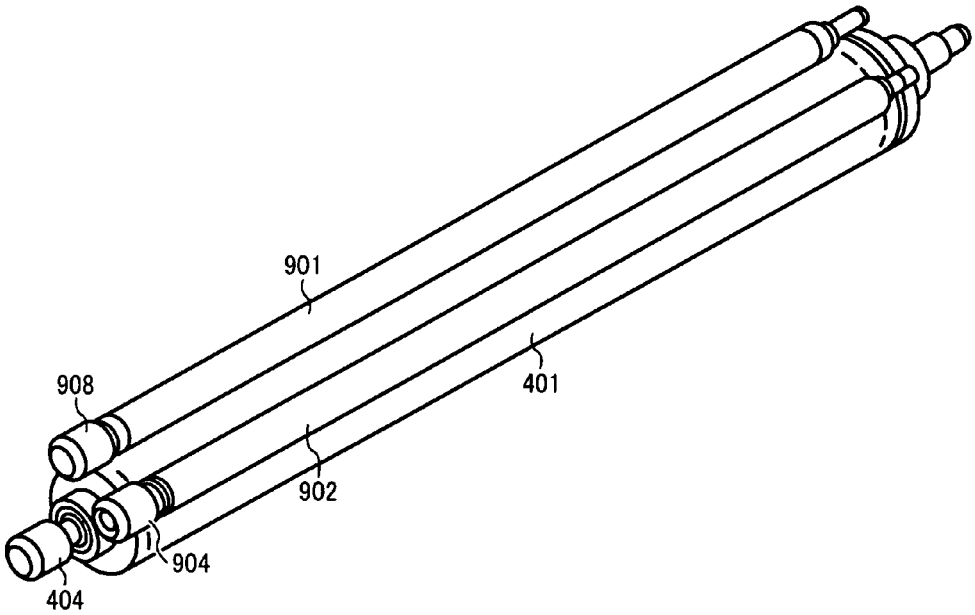

FIG. 4A shows an example in which a photosensitive member 401 and a developing roller 405 serve as driven-side rotating bodies. The photosensitive member 401 is rotatably supported on a main body of an image forming apparatus by bearings 402 and 403, and the drive force is transmitted to the photosensitive member 401 by a driven-side involute spline joint 404. The developing roller 405 associated with the photosensitive member 401 is rotatably supported relative to the photosensitive member 401 by bearings 406 and 407, and the drive force is transmitted to the developing roller 405 by a driven-side involute spline joint 408. Since the bearings 406 and 407 of the developing roller 405 are provided to ensure a positional accuracy between the driving roller 405 and the photosensitive member 401, the gap between surfaces of the photosensitive member 401 and the developing roller 405 can be accurately maintained, and this improves the image quality. Similar advantages can be expected by using involute spline joints 903 and 904 for the rotating bodies provided around the photosensitive member 401, for example, a charging roller 901 and a lubricant application brush 902, as well as the developing roller 405 (see FIG. 4B).

Figure 5:
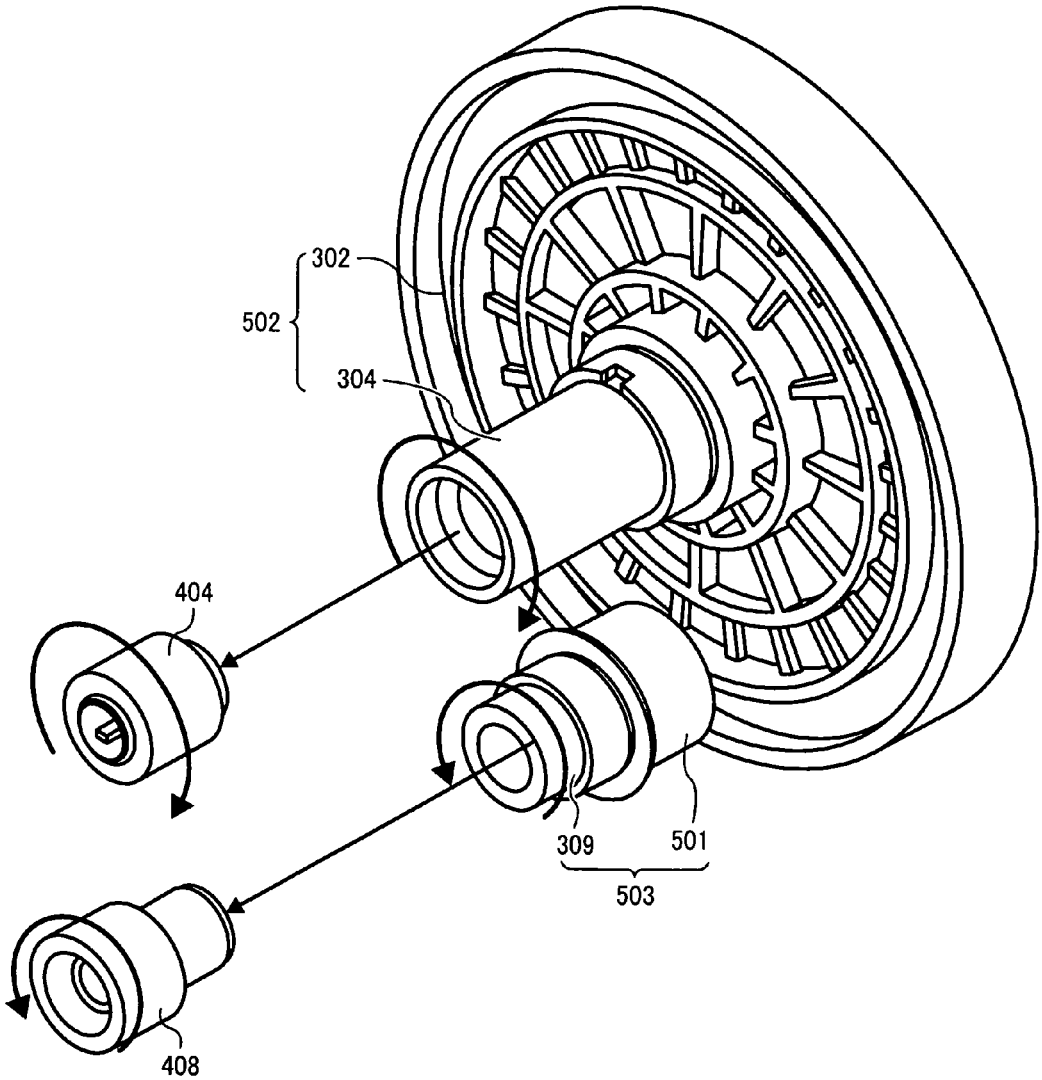
FIG. 5 shows a coupling method only with reference to a joint section.

FIG. 5 shows the coupling method only with reference to the joint section. In a photosensitive member system serving as the first rotating-body driving system, the driven-side involute spline joint 404 coupled to the photosensitive member 401 is guided in the thrust direction toward the driving-side involute spline joint 304 provided in the apparatus body, as shown in FIG. 5, and the internal involute spline joint and the external involute spline joint are meshed with each other. This allows smooth transmission of rotation. Similarly, in a developing roller system serving as the second rotating-body driving system, the driven-side involute spline joint 408 coupled to the developing roller 405 is guided in the thrust direction toward the driving-side involute spline joint 309 provided in the apparatus body, as shown in FIG. 5, and the internal involute spline joint and the external involute spline joint are meshed with each other. This allows smooth transmission of rotation. While the driving-side involute spline joints 304 and 309 are internal joints and the driven-side involute spline joints 404 and 408 are external joints in FIG. 5, the internal and external structures are not limited thereto. In order to improve removability in the thrust direction, it is effective to shape the involute spline joint so as to be easily guided, for example, by providing the involute splines with acute end faces or extending one of the splines longer in the thrust direction, as shown in FIG. 6A.

In the state in which the joints are not fitted, as shown in FIG. 5, the distance between the involute spline joints 304 and 404 for the photosensitive member system serving as the first rotating-body driving system is set to be less than the distance between the involute spline joints 309 and 408 for the developing roller system serving as the second rotating-body driving system. In this case, the involute joints for the photosensitive member system are first fitted, and the developing roller system is guided along the photosensitive member system. This allows the image forming unit to be more easily mounted in the apparatus body. Preferably, at the time when the involute spline joints 304 and 404 for the photosensitive member system are meshed, a gap of, for example, about 2 to 5 mm is left between the involute spline joints 309 and 408 for the developing roller system.

Since the driving-side involute spline joint 304 for the photosensitive member system and the driving-side involute spline joint 309 for the developing roller system are rotatably supported by the bearings provided in the shaft support member 303 fixed to the main body of the imaging forming apparatus, as shown in FIG. 3, the positional accuracy therebetween is ensured easily. In contrast, it is difficult to ensure the positional accuracy between the driven-side involute spline joints 404 and 408 because of accumulation of dimensional tolerances and geometric tolerances. Accordingly, the positional accuracy between the involute spline joints 304 and 404 in the photosensitive member system is ensured by first positioning the photosensitive member system relative to the apparatus body, as described above. For the involute spline joints 309 and 408 in the developing roller system, the internal involute splines are subjected to positive profile shifting, and the external involute splines are subjected to negative profile shifting, thus designing the gap between the alpine top and the spline bottom to be larger than the standard gap. This accepts axis misalignment due to accumulation of dimensional tolerances and geometric tolerances. Herein, the addendum modification coefficient is set to be within a range that accepts the maximum amount of accumulation of dimensional tolerances and geometric tolerances and that allows the joints to be meshed sufficiently. In other words, since the drive transmission couplings of two systems are formed by involute splines, smooth rotation is achieved and axis misalignment therebetween can be accepted.

Figure 6A:
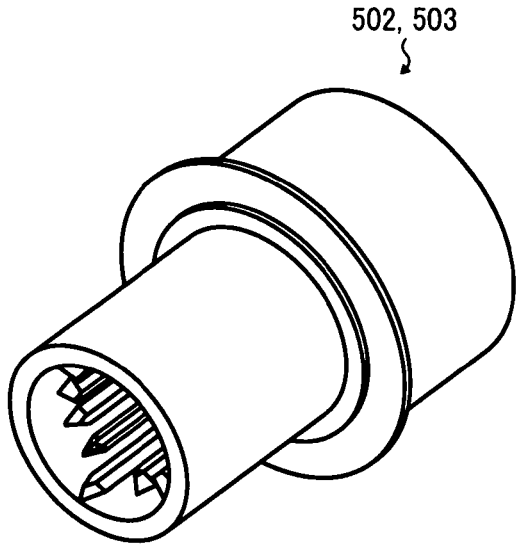
FIGS. 6A and 6B show an example in which an involute spline joint and a speed reduction member that are coaxial with each other are combined into one component.
Figure 6B:
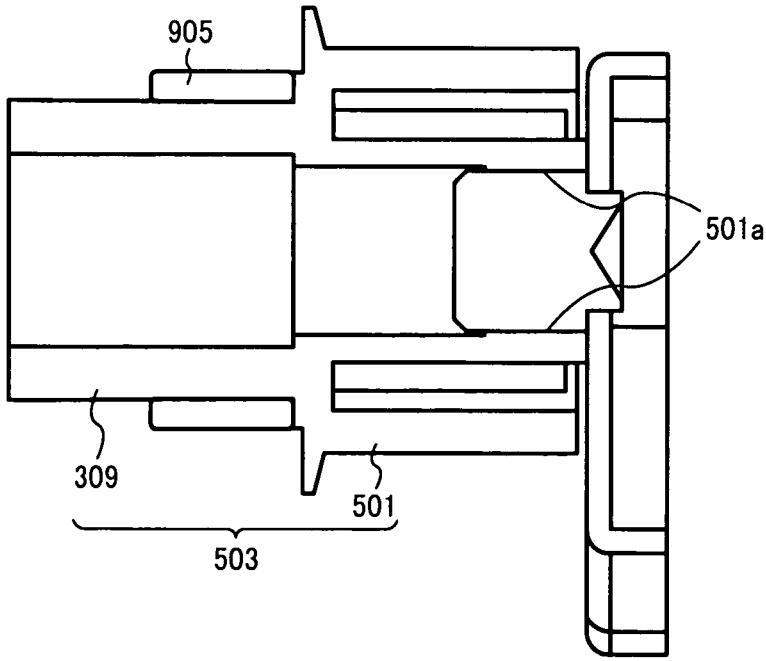

In order to improve the image quality, it is effective to combine the involute spline joints 304 and 309 and the speed reduction members 302 and 501 coaxial therewith into integral components (502 and 503) in the drive transmission device, as shown in FIGS. 6A and 6B. The speed reduction members 302 and 501 are formed by gears or toothed pulleys. This combination reduces the number of components and cost. Moreover, the combination reduces accumulation of dimensional tolerances due to a plurality of components, and removes assembly error. As a result, rotational fluctuations of the driven rotating bodies are reduced, and high image quality is achieved.

Figure 7:
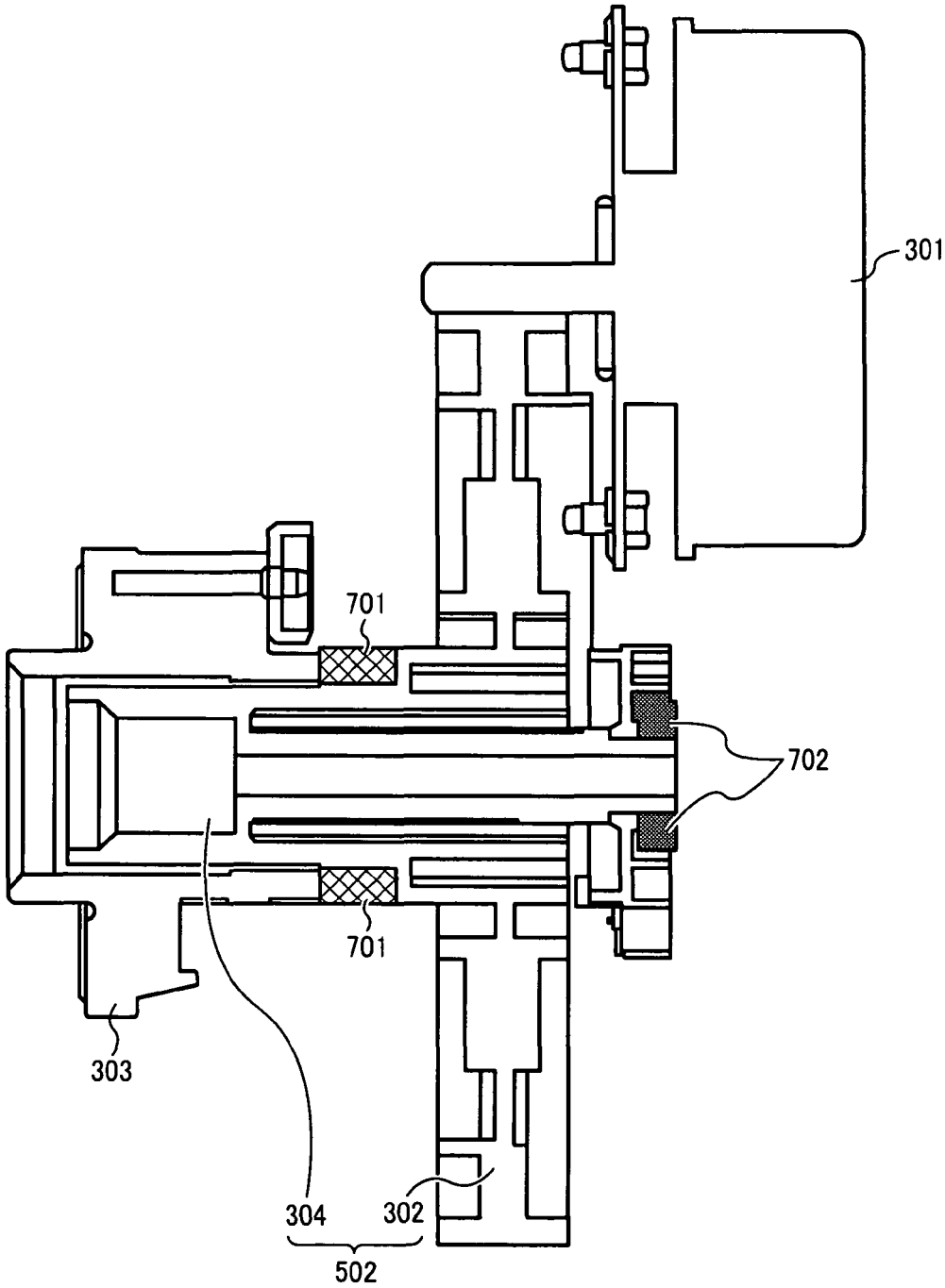
FIG. 7 is a cross-sectional view of a typical drive transmission device in a photoconductive member system.

FIG. 7 is a cross-sectional view showing the drive transmission device in the photosensitive member system as a representative. The drive transmission device includes the driving motor 301, the gear 302 for reducing the driving speed of the driving motor 301, the involute spline joint 304, and the shaft support member 303 fixed to the apparatus body. The involute spline joint 304 is rotatably supported in the drive transmission device by a joint-side bearing 701 and an opposite-side bearing 702. By using ball bearings or sliding bearings as the bearings 701 and 702 so as to increase the dimensional accuracy and coaxiality of the drive transmission device, coaxiality of the integral component 502 including the speed reduction member 302 is ensured. Therefore, dimensional tolerances of the bearings 701 and 702 can be required strictly. However, since the cost is increased by increasing the dimensional accuracy and coaxiality of the drive transmission device, first, the position of the integral component 502 including the speed reduction member 302 is positioned mainly relative to the bearing 702 at the rear end in order to reduce the accuracy while maintaining a sufficient function. For example, the dimensional tolerance is set so that the bearing inner diameter is 8 mm (+0.03/0) and the joint outer diameter is 8 mm (−0.005/−0.025).

The tolerance of the joint-side bearing 701 is set so that rattling is allowed in order to absorb dimensional error of the drive transmission device. For example, the joint outer diameter is set at 20 mm (0/−0.05) and the bearing inner diameter is set at 20.2 mm (+0.05/0). Similarly, the integral component 503 including the speed reduction member 501 is positioned mainly relative to a bearing portion 501*a* of the speed reduction member 501 at the rear end in the developing roller system, as shown in FIG. 6B. For example, the dimensional tolerance is set so that the bearing inner diameter is 8 mm (+0.03/0) and the joint outer diameter is 8 mm (−0.005/−0.025). The tolerance of a joint-side bearing 905 is set so that rattling is allowed in order to absorb dimensional error of the drive transmission device. For example, the joint outer diameter is set at 15 mm (0/−0.05) and the bearing inner diameter is set at 15.2 mm (+0.05/0).

Figure 8:
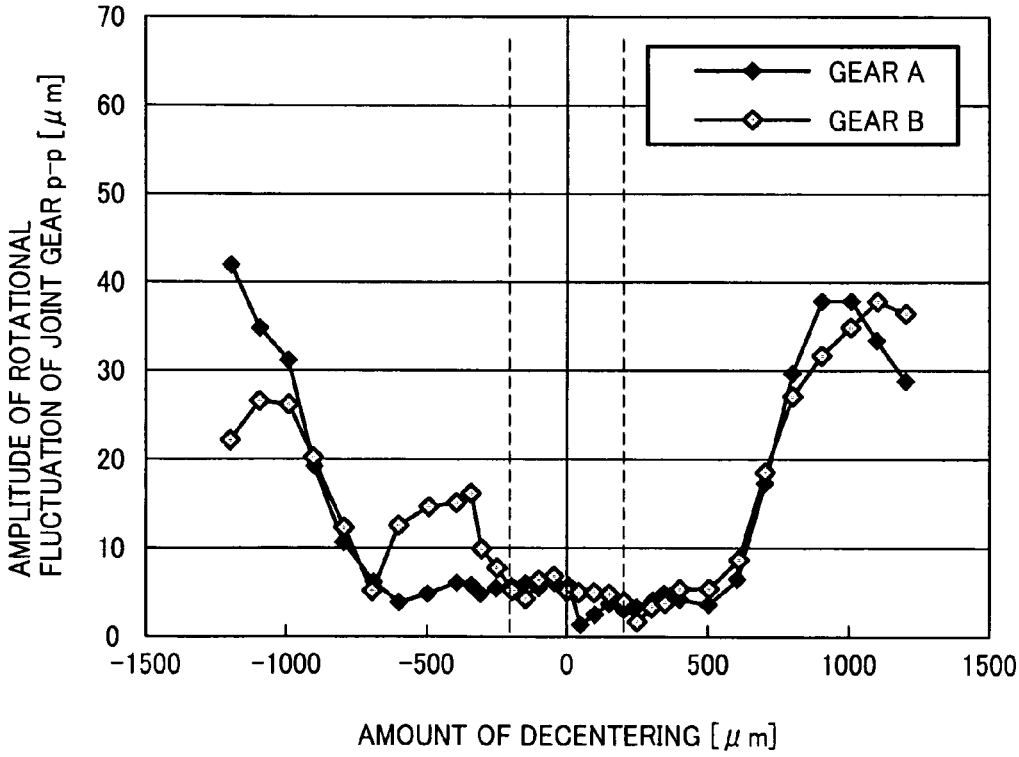
FIG. 8 shows decentering caused in a joint-side bearing.

As shown in FIG. 8, as decentering of the joint-side bearing increases, the fluctuation amplitude in one rotation of the joint gear increases. However, it has been experimentally verified that the rotational fluctuation is not increased even when decentering of about 200 μm occurs, as shown by dotted lines in FIG. 8.

Figure 9:
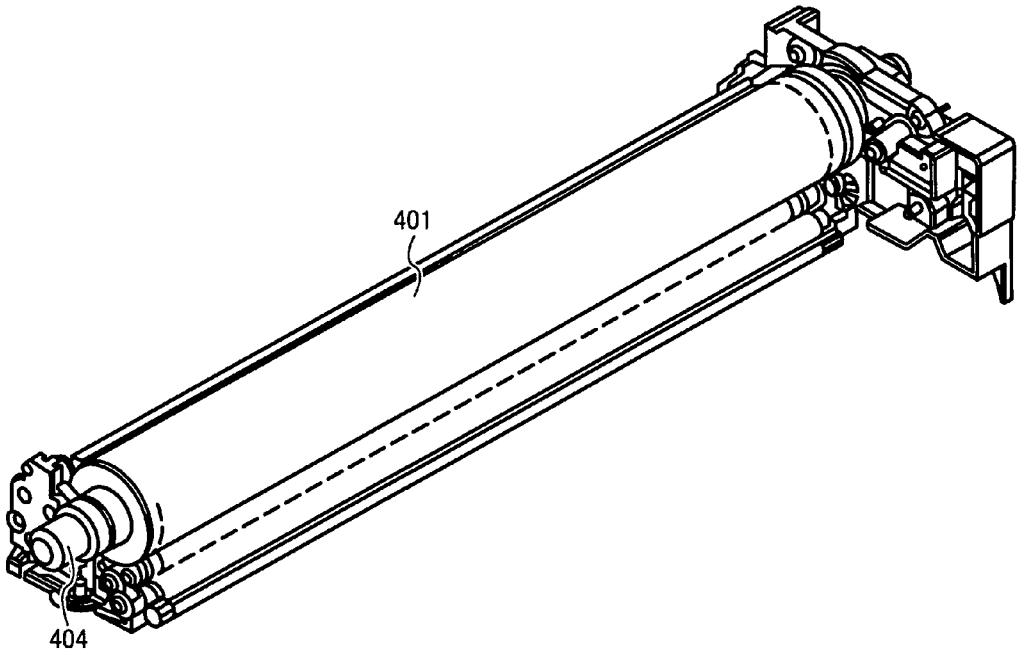
FIG. 9 shows an example in which the drive transmission device is used to drive a photosensitive member in an image forming apparatus.

FIG. 9 shows an example in which the drive transmission device according to the embodiment is used to drive a photosensitive member in an image forming apparatus. A photosensitive unit that is removable from the apparatus body in the thrust direction is provided with a driven-side external gear (involute spline joint) 404. This structure can reduce rotational fluctuations of a photosensitive member 401 that easily affects an image because the photosensitive member 401 directly bears the image.

Figure 10:
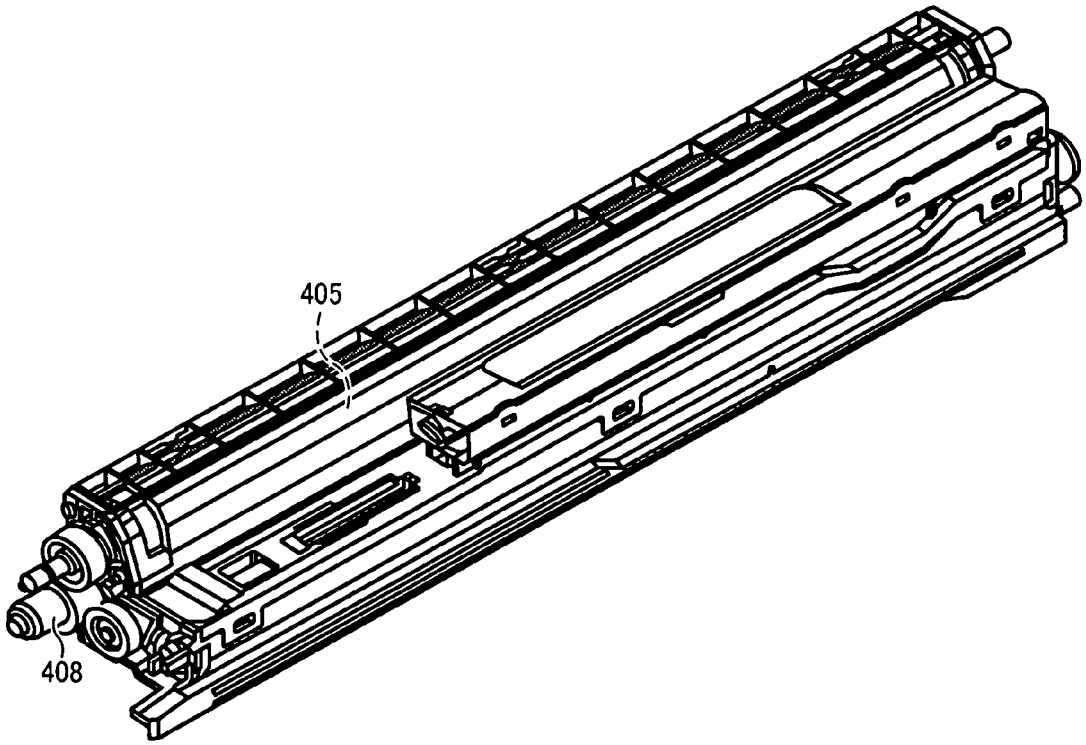
FIG. 10 shows an example in which the drive transmission device is used to drive a developing unit in the image forming apparatus.

FIG. 10 shows an example in which the drive transmission device according to the embodiment is used to drive a developing roller in the image forming apparatus. A developing unit that is removable from the apparatus body in the thrust direction is provided with a driven-side external gear (involute spline joint) 408. This structure can reduce rotational fluctuations of a developing roller 405 that has a relatively high driving torque and that are susceptible to rotational fluctuations.

Figure 1:
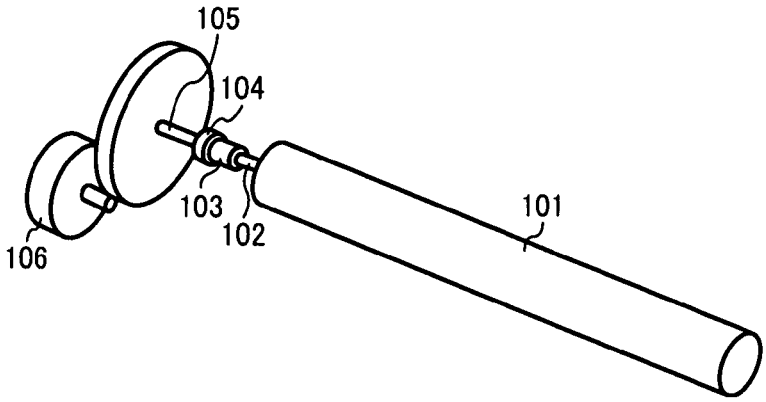
FIG. 1 is a perspective view schematically showing a configuration of a rotation transmission device using an involute spline joint.

A color image forming apparatus, such as the tandem color copying machine or color printer shown in FIG. 1, includes a plurality of image forming units corresponding to colors. Each image forming unit is formed by a process cartridge in which a unit including a photosensitive member and a developing unit are combined. By combining image forming elements in removable units, as described above, the components of each image forming unit can be replaced with respect to each color in response to time degradation or consumption of developing agent. This reduces the maintenance cost.

This document claims priority and contains subject matter related to Japanese Patent Application No. 2007-238744, filed on Sep. 14, 2007, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed is:

1. A process cartridge system, comprising:

a drive transmission device that performs drive transmission;

a primary rotating body configured to be driven by the drive transmission device;

a secondary rotating body configured to be driven by the drive transmission device;

a first involute spline joint configured to perform drive transmission to the primary rotating body to be driven;

a second involute spline joint configured to perform drive transmission to the secondary rotating body to be driven, the first involute spline joint includes:

a driven-side involute spline joint coupled to the primary rotating body; and a driving-side involute spline joint provided in a body of an image forming apparatus; and the second involute spline joint includes:

a driven-side involute spline joint coupled to the secondary rotating body; and a driving-side involute spline joint provided in the body of the image forming apparatus, wherein the driven-side involute spline joint of the first involute spline joint is guided towards the driving-side involute spline joint of the first involute spline joint, and the driven-side involute spline joint of the second involute spline joint is guided towards the driving-side involute spline joint of the second involute spline joint, wherein a distance between the driven-side involute spline joint of the first involute spline joint and the driving-side involute spline joint of the first involute spline joint is less than a distance between the driven-side involute spline joint of the second involute spline joint and the driving-side involute spline joint of the second involute spline joint, in a state when the joints are not fitted.

2. The process cartridge system according to claim 1, wherein the first involute spline joint for the primary rotating body is coupled earlier than the second involute spline joint for the secondary rotating body.

3. The process cartridge system according to claim 1, wherein each of the first and second involute spline joints is combined with a speed reduction mechanism.

4. The process cartridge system according to claim 1, wherein a dimensional tolerance of a joint-side bearing of each of the first and second involute spline joints is set to accept axis misalignment and a dimensional tolerance of an opposite-side bearing is set to be a dimensional tolerance for determining a position of an axis of each of the first and second involute spline joints.

5. The process cartridge system according to claim 1, wherein the primary rotating body is a photosensitive member, and the secondary rotating body is a developing roller.

6. An image forming apparatus comprising:

the process cartridge system of claim 1.

* * * * *